United States Patent [19]

Kunieda

[11] Patent Number: 4,535,480

[45] Date of Patent: Aug. 20, 1985

[54] ONE-PIECE GARMENT

[75] Inventor: Hirohiko Kunieda, Ogaki, Japan

[73] Assignee: Hinomaru Seni Co., Ltd., Ogaki, Japan

[21] Appl. No.: 567,983

[22] Filed: Jan. 5, 1984

[30] Foreign Application Priority Data

Oct. 4, 1983 [JP] Japan ..... 58-154609

[51] Int. Cl.[3] ..... A41D 1/06

[52] U.S. Cl. ..... 2/079

[58] Field of Search ..... 2/79, 71, 114, 78 A, 2/78 B, 78 C, 78 D, 80

[56] References Cited

U.S. PATENT DOCUMENTS 1,405,421 2/1922 Keck et al. ..... 2/79

1,626,024 4/1927 Crane ..... 2/79 UX 1,783,485 12/1930 Shaw ..... 2/79

3,852,824 12/1974 Gray ..... 2/79

*Primary Examiner*—Doris L. Troutman

*Attorney, Agent, or Firm*—Martin A. Farber

[57] ABSTRACT

The back of a one-piece garment is separated into two parts, upper and lower, by a horizontal opening formed in the small of the back and which is connected at both extremities to vertical slits formed along both sides of the garment. The upper half of the back has fastener members on its lower corners with which it can be secured to the front. The lower half has an elastic belt at its upper edge and fasteners along the slits, which together make the garment fit the wearer well at work or during exercise.

5 Claims, 5 Drawing Figures

ONE-PIECE GARMENT

BACKGROUND OF THE INVENTION

1. Field of the Invention

This invention relates to a one-piece garment for use as working wear, coveralls, a jump suit or skiwear, etc.

2. Description of the Prior Art

A conventional one-piece garment of the type which has a back part whose upper and lower halves are sewn together is very inconvenient in that the wearer has to take it off whenever nature calls. In order that the wearer may ease nature with the garment still on, it has been proposed to cut the back thereof at the waist into upper and lower halves and separately fasten them together. In regular use, the two halves are non-elastically joined together by buttons or the like. If the wearer stoops or crouches, therefore, his back, and hence the back of the garment, stretch, making his movements uneven and cramped, especially when the garment is used for working or sports. As attempts to circumvent these difficulties, one-piece garments whose back is separated into upper and lower halves, with the upper end of the lower half being extended so as to overlap the lower end of the upper half and be fastened to it with a belt or the like, have been taught in the specifications of Japanese Utility Model Laid-Open Nos. 176315/1980 and 56707/1982. However, the upward extension of the lower half over the lower end of the upper half allows dirt from the outside into the overlap. To eliminate this drawback, the reversal of this overlap, so that the upper half of the back extends downward over the lower half, has been advocated in the specification of Japanese Utility Model Laid-Open No. 15256/1980. In this case the upper end of the lower half does not elastically expand sideways, preventing the unconstricted movement of the wearer. Moreover, because the lower end of the upper half is not secured to any other part of the garment, there is the danger of the extension being caught in something else, or being turned inside out to mar the appearance, while the wearer is at work or otherwise in motion.

SUMMARY OF THE INVENTION

In view of the above, it is an object of the present invention to provide a one-piece garment which overcomes these problems and is best suited for practical use.

The objective of the invention is realized by a one-piece garment characterized in that its back is divided at the waist into upper and lower halves, and is also slit so that it is separated from the front 3 along both sides, a seat flap 2*a* extends upward from the lower half 2 of the back to the waist, a hanging flap 1*a* extends downward from the upper half 1 of the back so that its lower end overlaps the outer surface of the seat flap 2*a*, both sides of the seat flap 2*a* are separably attached to the front 3, an elastic waist band 5 which can expand sideways is provided in an upper portion of the seat flap 2*a*, female fastener members 6, 6' are attached to both sides of the hanging flap 1*a*, and male fastener members 7, 7' which can engage with the female ones are attached to both sides of the front 3, the hanging flap 1*a* and the seat flap 2*a* being not attached to each other.

The above and other objects, features and advantages of the invention will become clear from the following description of the preferred embodiments taken in conjunction with the accompanying drawings.

DETAILED DESCRIPTION OF THE PREFERRED EMBODIMENTS

Figure 3:
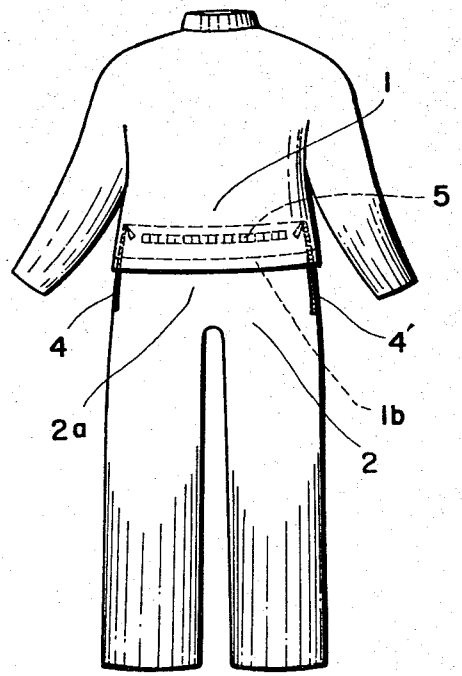
FIG. 3 is a rear view of the embodiment in use.
Figure 2:
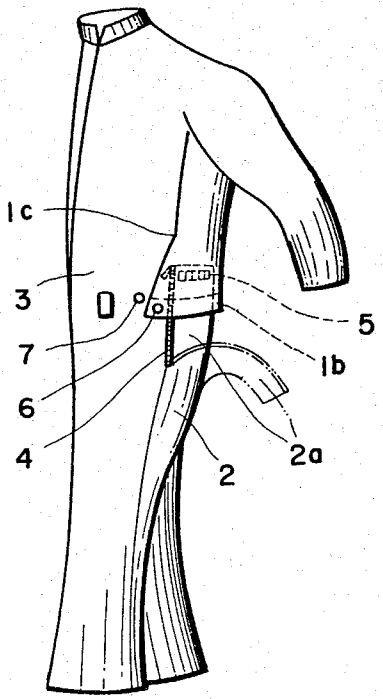
FIG. 2 is a side view of the embodiment.
Figure 1:
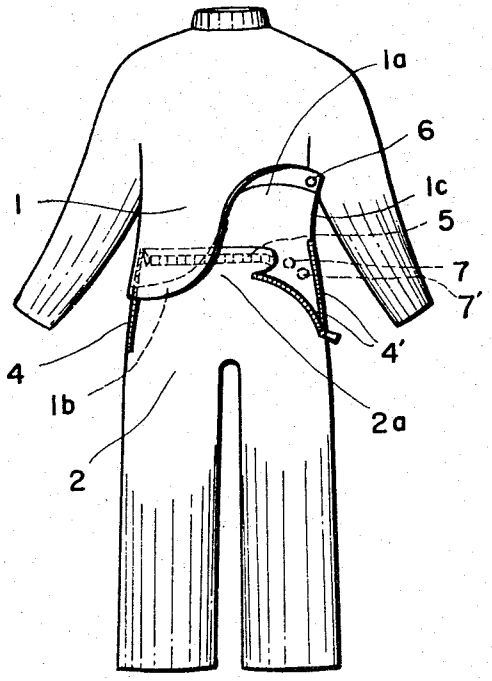
FIG. 1 is a rear view of a one-piece garment embodying the invention, with a hanging flap and a seat flap partly turned inside out.
Figure 5:
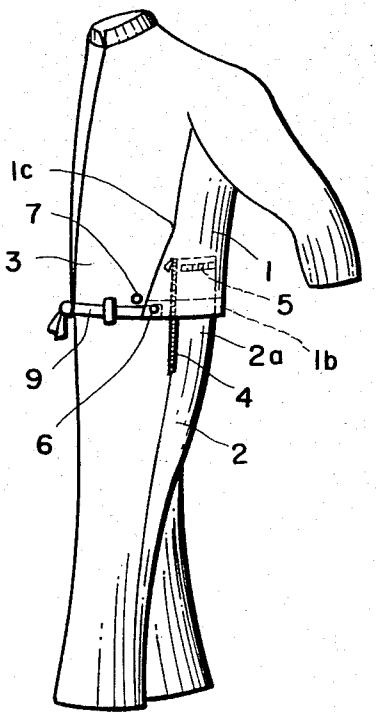
FIG. 5 is a side view of yet another embodiment provided with an ornamental strap.
Figure 4:
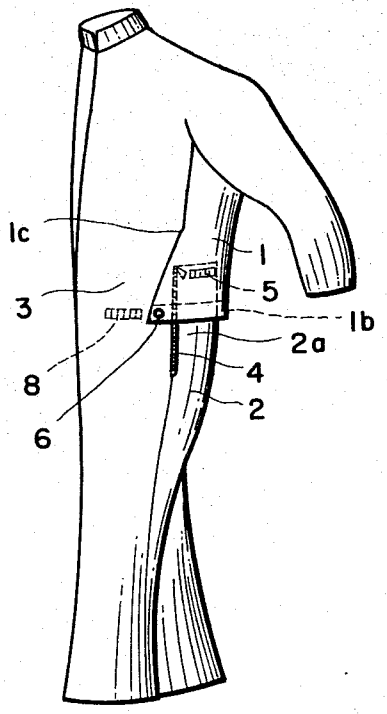
FIG. 4 is a side view of another embodiment.

Referring to the drawings, the back of the garment is divided at the waist into two halves, an upper half 1 and a lower half 2. The back is partly separated at both sides from the front 3 by slits extending vertically from the upper left and right corners of the lower half 2 down to points corresponding to the lower end of the wearer's seat. The slits are each provided with a zip fastener 4 to provide an openable seat flap 2*a* between them. The zip fasteners 4 may be replaced by buttons or other separable fasteners. The upper end of the seat flap 2*a* is provided with an elastic waist band 5 or the like to allow elastic sidewise expansion. The lower end portion of the upper half 1 is separated at both sides from the front 3 to form an openable hanging flap 1*a*. This flap 1*a* overlaps the seat flap 2*a* by a sufficient downward extension to ensure that the upper end of the seat flap 2*a* is not exposed by the lower end of the flap 1*a*, even when the wearer stoops or crouches. The hanging flap 1*a* has a strip of lining 1*b* along the entire length of its lower end to provide protection against creasing during washing, and so that the flap 1*a* gives a coat-like appearance to the upper half of the garment. Separation points 1*c* at both upper corners of the hanging flap 1*c*, where the flap separates from the front 3, are located a short distance above the upper end of the seat flap 2*a* to facilitate the up-and-down movement of the slides of the zip fasteners 4. The flap 1*a* has a female fastener member 6 affixed to each of its lower corners, and the front 3 has a corresponding male fastener member 7 affixed to each side of the waist. A plurality of such male fastener members 7 can be provided on each side, spaced along the waistline to permit the wearer to choose an appropriate fastening position depending on his waist measurement. Instead of adjusting the position at which the hanging flap 1*a* is fastened in this manner, it is possible, as indicated in FIG. 4, to affix only one male fastener member 7 on each side of the waist of the front 3 and attach a short length of elastic waistband 8 to provide elastic contraction around the waistline. The female and male fastener members 6, 7 can be the socket and ball members of snap fasteners, hooks and eyes, mating lengths of Velcro tape, holes or loops and buttons, or other similar combinations, FIG. 5 illustrates another embodiment of the invention in which an ornamental strap 9 is attached to the front. Each end of the strap 9 has on one side a member adapted to engage with the female fastener member 6 of the hanging flap 1*a*, and on the other side a member adapted to engage with the male fastener member 7 on the corresponding side of the waist of the front 3.

When nature calls, the wearer pulls the corners of the hanging flap 1*a* with its female fastener members 6 out of engagement with the male members 7 to open the flap, and then unzips the two fasteners 4, 4' to fold down the seat flap 2*a* to enable urination or defecation. Afterwards, the wearer zips up both zip fasteners 4, 4' so that the hanging flap 1*a* overlaps the outer surface of the seat flap 2*a*, and then snaps or otherwise fastens the female fastener members 6, 6' on both corners of the hanging flap 2*a* to the male members 7, 7' on the front 3.

Because both lower corners of the hanging flap 1*a* are thus fastened in place, there is no danger of the flap 1*a* turning up to expose the inside, or being caught by something while the wearer is at work or in motion. When the user bends forward, the upper half of the back of the garment is pulled upward, and the lower half downward. With the garment of the invention, however, the separated upper and lower half parts 1, 2 follow these pulls individually, causing no tension on the back of the wearer and allowing him to work or move easily. When the stooping or crouching werarr straightens his back, the upper middle portion of the seat flap 2*a* returns from its downwardly stretched position to its original relaxed position. This is readily achieved because, for one thing, the upper middle portion of the seat flap 2*a* is pulled up by the contraction of the elastic waistband 5 while both sides of the flap are secured to the front by the zip fasteners 4 and, for another, the hanging flap 1*a* does not press against the upper end of the seat flap 2*a*.

The garment of the present invention, as described above, enables the wearer to answer nature's calls with ease by simply unfastening the seat flap 2*a*.

Both the hanging flap 1*a* and the seat flap 2*a* are connected to the front and are not connected to each other. The hanging flap 1*a* merely laps the seat flap 2*a* to cover the outer surface of the latter. Therefore, the wearer can bend forwards without any feel of tension on his back because the opening formed by the hanging flap and the seat flap serve to absorbs the tension. The hanging flap 1*a* of the upper half, overlapping the upper end of the seat flap 2*a* of the lower half, keeps dirt out of the space between the two flaps 1*a*, 2*a*. The elastic waistband 5 provided in the upper portion of the seat flap 2*a* permits easy, light waist motion. When the stooping or crouching wearer stands upright again, the seat flap 2*a* readily returns from its downward to its original position because it is connected at both side edges to the front of the garment, has the elastic waistband 5 in its upper portion, and the lower end of the hanging flap 1*a* is fastened to both sides of the front 3 without pressing against the outside of the flap 2*a*. Thus, when the wearer straightens his back, there is no possibility of the seat flap 2*a* bulging outward to impair the appearance of the garment. Further, at the side of the opening near the small of the back adjacent to the upper half of the back, a hanging flap 1*a* is formed to have a point 1*c* of separation from the front positioned above the upper edge of the seat flap 2*a*, the lower end of the hanging flap being enlarged beyond both side edges of the seat to lap the seat flap 2*a*, the enlarged lower portion of the hanging flap being provided with a fastener 6 for fastening to the front 3. Therefore, the fastening can be made easily and, in addition, there is no possibility of the hanging flap being turned up or being caught by any foreign object to mar the appearance, while the wearer is at work or in motion. Thus, the garment of the invention offers practical advantages as a one-piece garment.

What is claimed is:

1. A one-piece garment comprising:

an opening formed in a portion of the back near the small of the back, a seat flap provided at the side of said opening adjacent to the lower half of said back, said seat flap having an upper edge extending to a portion near said small of the back and both lateral side edges openably connected to the front, said seat flap being provided at its upper end portion with a horizontally stretchable rubber belt;

a hanging flap extending from the top of said opening adjacent to the upper half of the back and having a point of separation from said front positioned above the upper edge of said seat flap, said hanging flap having an enlarged lower end extending beyond both side edges of said seat flap to lap said seat flap; and a first set of fasteners attached to the enlarged lower end of said hanging flap, and a second set of fasteners which mate with the first set of fasteners, said second set of fasteners being attached to both sides of the front of the garment at locations corresponding to said enlarged lower end of said hanging flap.

2. The one-piece garment according to claim 1, wherein said seat flap is opened and closed along both sides thereof by means of zip fasteners.

3. The one-piece garment according to claim 1 or 2, wherein said hanging flap has a lining along the lower edge thereof.

4. The one-piece garment according to claim 1, 2 or 3, wherein said hanging flap extends downward from separation points located above the upper end of said seat flap.

5. The one-piece garment according to claim 1, wherein said hanging flap overlaps the exterior surface of said seat flap.

* * * * *